US010454170B2

(12) United States Patent
Doodeman

(10) Patent No.: US 10,454,170 B2
(45) Date of Patent: Oct. 22, 2019

(54) MULTI-MAGNETIC LOOP ANTENNA WITH A SINGLE FEED TO PARALLEL LOOPS

(71) Applicant: KONINKLIJKE PHILIPS N.V., Eindhoven (NL)

(72) Inventor: Gerardus Johannes Nicolaas Doodeman, Veldohoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/737,903

(22) PCT Filed: Jun. 17, 2016

(86) PCT No.: PCT/EP2016/064045
§ 371 (c)(1),
(2) Date: Dec. 19, 2017

(87) PCT Pub. No.: WO2016/202996
PCT Pub. Date: Dec. 22, 2016

(65) Prior Publication Data

US 2018/0301811 A1 Oct. 18, 2018

Related U.S. Application Data

(60) Provisional application No. 62/181,987, filed on Jun. 19, 2015.

(51) Int. Cl.
*H01Q 1/27* (2006.01)
*H01Q 5/40* (2015.01)
(Continued)

(52) U.S. Cl.
CPC ..... *H01Q 7/00* (2013.01); *H01Q 1/273* (2013.01); *H01Q 5/364* (2015.01); *H01Q 5/40* (2015.01); *H01Q 21/30* (2013.01)

(58) Field of Classification Search
CPC ..... H01Q 5/364; H01Q 7/00; H01Q 7/06; H01Q 21/30
See application file for complete search history.

(56) References Cited

U.S. PATENT DOCUMENTS 2,324,462 A 7/1943 Leeds et al.
2,467,961 A 4/1949 Caraway et al.
(Continued)

FOREIGN PATENT DOCUMENTS

CH 702226 B1 5/2011
DE 102006011724 A1 9/2007
(Continued)

OTHER PUBLICATIONS

Kim et al: "Electrically Small Loop Antenna Using the MNG Ground Plane Structure"; IEEE Antennas and Propagation Society International Symposium, 2008, AP-S , pp. 1-4.
(Continued)

*Primary Examiner* — Robert Karacsony

(57) ABSTRACT

A device (502) includes a multi-loop antenna (516) with at least two magnetic loop antennas (602, 604) electrically connected in parallel. The at least two magnetic loop antennas each are configured to transmit and receive signals over predetermined frequency bands. The device further includes a single feed line (524) configured to drive both of the at least two magnetic loop antennas and a wireless communication component (510) configured to drive the single feed line. A method includes receiving a first activation signal for a first magnetic loop antenna of at least two magnetic loop antennas electrically connected in parallel, feeding the first magnetic loop antenna with a feed line, receiving a second activation signal for a second magnetic loop antenna of the
(Continued)

at least two magnetic loop antennas electrically connected in parallel, and feeding the second magnetic loop antenna with the same feed line.

15 Claims, 12 Drawing Sheets

(51) Int. Cl.

| | |
|---|---|
| ***H01Q 7/00*** | (2006.01) |
| ***H01Q 21/30*** | (2006.01) |
| ***H01Q 5/364*** | (2015.01) |

(56) References Cited

U.S. PATENT DOCUMENTS

| | | | |
|---|---|---|---|
| 3,588,905 | A | 6/1971 | Dunlavy, Jr. |
| 5,557,293 | A | 9/1996 | McCoy et al. |
| 6,166,694 | A | 12/2000 | Ying |
| 8,831,630 | B2 | 9/2014 | Bentley |
| 2010/0134366 | A1 | 6/2010 | Yu |
| 2010/0328173 | A1 | 12/2010 | Rao |
| 2014/0097991 | A1 | 4/2014 | Zheng et al. |
| 2014/0132465 | A1 | 5/2014 | Sanchez et al. |
| 2014/0347244 | A1 | 11/2014 | Pagani et al. |

FOREIGN PATENT DOCUMENTS

| | | | |
|---|---|---|---|
| EP | 1672735 | A1 | 6/2006 |
| GB | 2436760 | | 10/2007 |
| WO | 2008000385 | A1 | 1/2008 |
| WO | 2014117738 | A1 | 8/2014 |
| WO | 2015011468 | A1 | 1/2015 |

OTHER PUBLICATIONS

Loubert: "Technology Developments in the RF Tracking and Locating of Personnel and Objects"; IEEE, Security Technology, 1992, Crime Countermeasures Proceedings, Institute of Electrical and Electronics Engineers, pp. 206-212.

Hirose et al: "Low-Profile Dual-Loop Antennas With at Stragith Wire for Circular Polarizaaton"; IEEE Antennas With a Stragith Wire for Circular Polarization, vol. 12. 2013, pp. 1180-1183.

Abdul-Kassem et al: "On Two Parallel Loop Antennas"; IEEE Transactions on Antennas and Propagation, vol. AP-28, No. 4, Jul. 1980, pp. 491-496.

PCT/EP2016/064045. ISR and Written Opinion, dated Aug. 29, 2016.

MULTI-MAGNETIC LOOP ANTENNA WITH A SINGLE FEED TO PARALLEL LOOPS

CROSS-REFERENCE TO PRIOR APPLICATIONS

This application is the U.S. National Phase application under 35 U.S.C. § 371 of International Application No. PCT/EP2016/064045, filed on Jun. 17, 2016, which claims the benefit of U.S. Provisional Patent Application No. 62/181,987 filed on Jun. 19, 2015. These applications are hereby incorporated by reference in their entirety herein.

FIELD OF THE INVENTION

The following generally relates to an antenna and more particularly to a multi-magnetic loop antenna with a single feed to multiple loops that are electrically in parallel.

BACKGROUND OF THE INVENTION

A portable wireless device, e.g. a cellphone, a wrist watch, etc. with built-in RF connectivity, contains and utilizes an antenna for wireless communication (transmit and receive). Some applications require more than one antenna. For example, wireless telecommunication operators have offered several generations of communication standards and different frequency bands. In such a case, at least two antennas tuned to at least two different frequency bands has been required to guarantee coverage over medium and longer distances. A changing dielectric environment exposes the antennas to frequency and impedance detuning. As a consequence, electric field antennas are not well-suited for such applications. However, magnetic loop antennas have low sensitivity to such dielectric changes.

FIGS. 1, 2, 3 and 4 show different configurations where a single feed drives two independent magnetic loop antennas. In FIG. 1, a single feed 100 feeds separate and distinct magnetic loop antennas 102 and 104 through separate inductive loops 106 and 108 connected in parallel. In FIG. 2, the single feed 100 feeds the magnetic loop antennas 102 and 104 through the separate inductive loops 106 and 108 connected in series. In FIG. 3, the single feed 100 feeds the magnetic loop antennas 102 and 104 through separate electrically conductive paths 302 and 304 connected in parallel. In FIG. 4, the single feed 100 feeds the magnetic loop antennas 102 and 104 through an electrically conductive path 402 in series.

Small portable wireless devices, such as wrist watch, have a limited amount of space for the components such as the antenna. Unfortunately, dual antenna configurations such as those shown in FIGS. 1-4 consume more space with the additional antenna and feed line relative to a single antenna configuration. Furthermore, the additional antenna and feed line increase overall cost and complexity of the device.

SUMMARY OF THE INVENTION

Aspects described herein address the above-referenced problems and others.

In one aspect, a device includes a multi-loop antenna with at least two magnetic loop antennas electrically connected in parallel. The at least two magnetic loop antennas each are configured to transmit and receive signals over predetermined frequency bands. The device further includes a single feed line configured to drive both of the at least two magnetic loop antennas and a wireless communication component configured to drive the single feed line.

In another aspect, an apparatus configured to be carried or worn by a user, includes a wireless mobile device. The wireless mobile device includes a multi-loop antenna with at least two magnetic loop antennas electrically connected in parallel. The at least two magnetic loop antennas each are configured to transmit and receive signals over predetermined frequency bands. The device further includes a single feed line configured to drive both of the at least two magnetic loop antennas and a wireless communication component configured to drive the single feed line.

In another aspect, a method includes receiving a first activation signal for a first magnetic loop antenna of at least two magnetic loop antennas electrically connected in parallel, feeding the first magnetic loop antenna with a feed line, receiving a second activation signal for a second magnetic loop antenna of the at least two magnetic loop antennas electrically connected in parallel, and feeding the second magnetic loop antenna with the same feed line.

The invention may take form in various components and arrangements of components, and in various steps and arrangements of steps. The drawings are only for purposes of illustrating the preferred embodiments and are not to be construed as limiting the invention.

DETAILED DESCRIPTION OF EMBODIMENTS

The following describes a multi-loop antenna that includes at least two magnetic loops connected electrically in parallel with a single common feed. Such a configuration provides a reduced number of components, complexity, cost and/or a consumption of space, relative to a configuration with multiple individual magnetic loops with separate fed lines such as those described in FIGS. 1-4.

Figure 1:
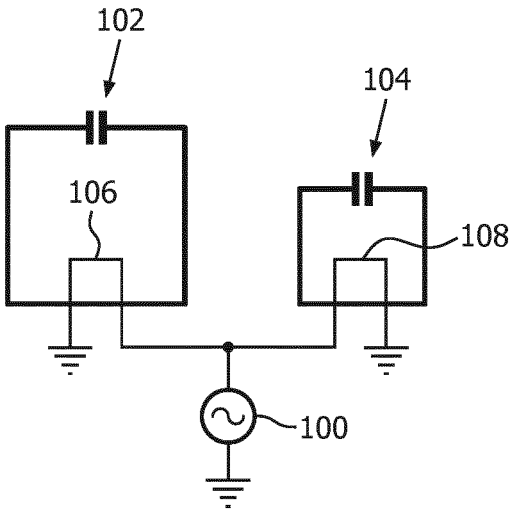
(Prior Art) FIG. 1
FIGS. 1-4 schematically illustrate prior art configuration of separate magnetic loop antennas being driven in parallel or in series with inductive couplings or electrical couplings.
Figure 2:
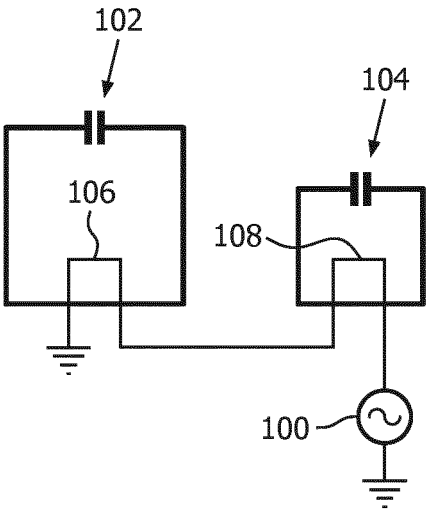
(Prior Art) FIG. 2
Figure 3:
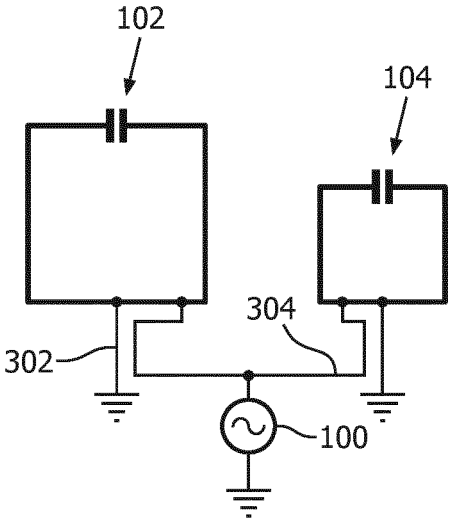
(Prior Art) FIG. 3
Figure 4:
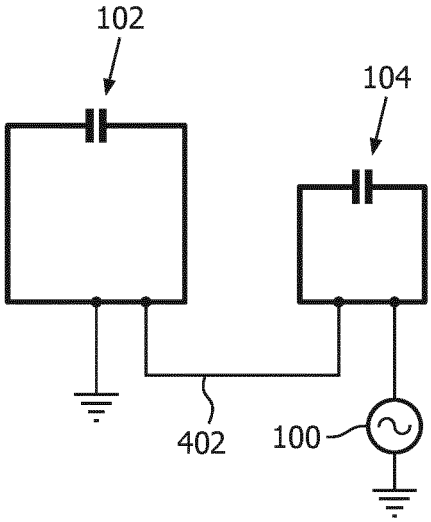
(Prior Art) FIG. 4
Figure 5:
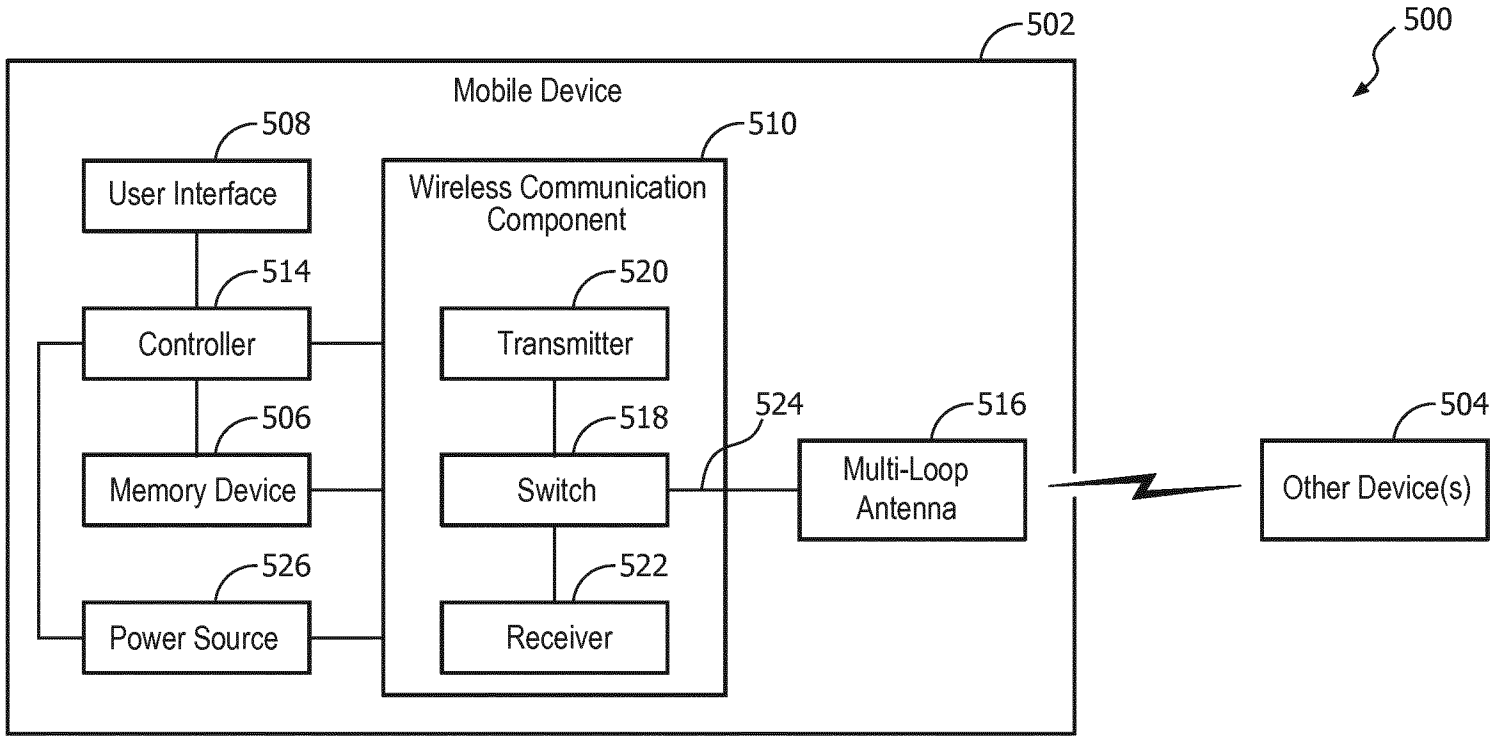
FIG. 5 schematically illustrates an example mobile device with a multi-loop antenna that includes at least two magnetic loops connected electrically in parallel with a single common feed.

Initially referring to FIG. 5, a system 500 includes a mobile device 502 and at least one other device(s) 504. In the illustrated example, the mobile device 502 and the at least one other device(s) 504 wirelessly communicate through a wireless transmission medium, such as radio frequency (RF). It is to be appreciated that the device 502 can also be configured to wirelessly communicate through other mediums such as light, a magnetic field, an electric field, sound, etc. The at least one other device(s) 504 includes a cellular tower, a router, another mobile device, a satellite and/or other wirelessly configured device.

The mobile device 502 includes a non-transitory physical medium (or memory device) 506 configured to store data, computer readable instructions, etc. The non-transitory physical medium excludes transitory medium. At least a sub-portion of stored information can be wirelessly transmitted from the mobile device 502 and/or previously wirelessly received by the mobile device 502. The mobile device 502 further includes a user interface 508, which may include a control (e.g., on/off, setup, etc.) and/or an output device (e.g., a display, a speaker, etc.) for interacting and/or controlling the mobile device 502.

The mobile device 502 further includes a wireless communication component 510 and a multi-loop antenna 516. The wireless communication component 510 includes a switch 518, transmitter circuitry ("transmitter") 520 and receiver circuitry ("receiver") 522. The switch 518 switches between the transmitter 520 and the receiver 522 respectively for transmit and receive operations. The transmitter 520 controls transmission of information, and the receiver 522 controls reception of information. The wireless communication component 510 drives a feed line 524, which drives the multi-loop antenna 516. As described in greater detail below, the multi-loop antenna 516 includes at least two magnetic loops electrically connected in parallel and with a single feed, for both transmission and reception, for all of the loops. As discussed herein, magnetic loops antennas are relatively insensitive to detuning under variable dielectric environment conditions and, thus, well-suited for mobile applications. Furthermore, the parallel configurations described herein have high efficiency (radiated power/input power). The magnetic loops antennas are tuned to predetermined frequencies, which can be the same or different frequencies.

The mobile device 502 further includes a controller 514. The controller 514 controls components of the mobile device 502 such as the wireless communication component 510. The mobile device 502 further includes a power source 526. The power source 526 supplies power to one or more components of the mobile device 502, such as the wireless communication component 510. Examples of suitable power sources include a battery (rechargeable and/or non-rechargeable), a super capacitor, etc.

In a variation, the mobile device 502 further includes a wired communication component and an electromechanical port. In one instance, the port is a socket configured to receive a complementary plug located at one end of a cable. The wired communication component controls communications of information via the port. Examples of suitable communication technologies include Ethernet, Universal Serial Bus, FireWire, etc. Suitable wireless and/or wired communication covers GPS, cellular, data, messaging, etc.

Figure 20:
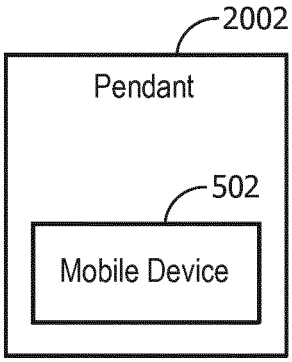
FIGS. 20 and 21 schematically illustrate the mobile device as part of a pendant.
Figure 21:
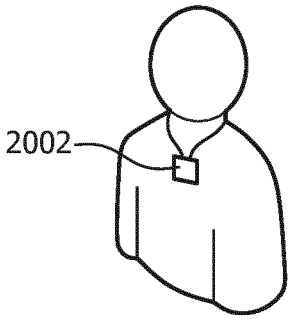

In one instance, the mobile device 502 is part an apparatus configured to be carried (e.g., a cell phone) and/or worn (e.g., a wrist band) by an individual. For example, the mobile device 502 can be part of a pendant necklace 2002 (FIGS. 20 and 21). In this instance, the mobile device 502 may be configured to transmit information related to the spatial orientation of the individual wearing the pendant necklace and/or make cellular phone calls. For example, the information transmitted from the mobile device 502 may be used to determine the location of the individual, whether the individual is in an upright (standing), sitting, or lying position, whether the individual is stationary, walking, or running, etc. Other information, such as the identity of the individual, a distress signal, etc. can also be transmitted. Such information can be useful for fitness applications, fall detection, telephone calls, etc. In general, the mobile device 502 can be any device, which operates on at least two different frequencies.

Figure 6:
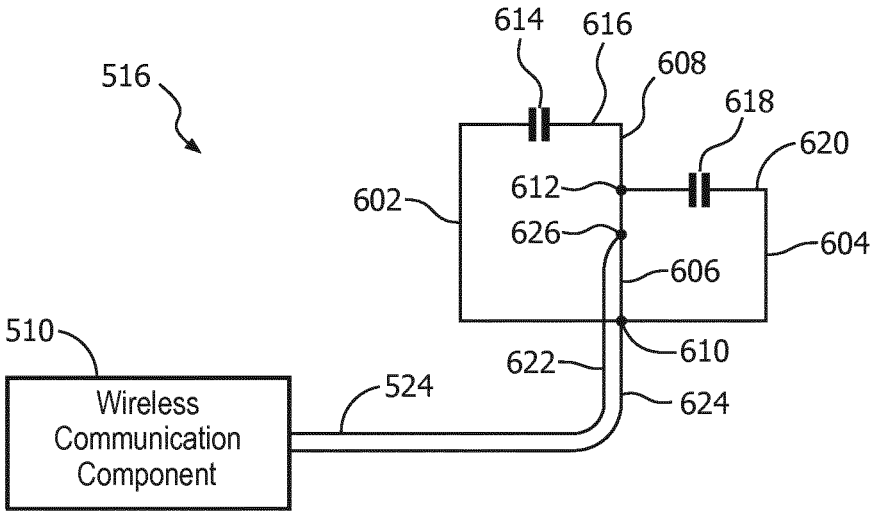
FIGS. 6 and 7 schematically illustrate an example of the multi-loop antenna and the single common feed.

FIG. 6 schematically illustrates an example embodiment of the wireless communication component 510, the multi-loop antenna 516, and the feed line 524 with an electrical coupling feeding the multi-loop antenna 516. The feed line 524 can be part of a coaxial cable, a micro-strip, or the like.

The multi-loop antenna 516 includes a first magnetic loop 602 and a second magnetic loop 604. The loops 602 and 604 can be small compared to the radiation wavelengths (e.g., on the order of or less than one tenth in width and length). An example loop is thirty by ten millimeters (30×10 mm) or less for an operating wavelength of thirty centimeters (30 cm). The first and second loops 602 and 604 are electrically connected in parallel. A common leg 606 is shared by the first and second loops 602 and 604 in that the common leg 606 is a sub-portion of a leg 608 of the first loop 602 and an entire leg of the second loop 604. The common leg 606, the first loop 602 and the second loop 604 intersect at junctions 610 and 612. In this parallel configuration, neither loop 602 or 604 will shorten the other loop 604 or 602. That is, the active loop will not be shorter than the inactive loop, as the inactive loop will conduct all of the electrical current.

A first capacitor 614 is in series with a first leg 616 of the first loop 602, and a second capacitor 618 is in series with a second leg 620 of the second loop 604. The 614 and 618 capacitors can include discrete and/or analog components. The first loop 602 with the first capacitor 614 is a first resonant inductive-capacitive (LC) circuit, and the second loop 604 with the second capacitor 618 is a second resonant LC circuit. The inductance is set once at the time of manufacture based on the geometry of the loops 602 and 604. The capacitance can be set once, e.g., at the time of manufacture, or, where variable capacitors are employed, can later be changed. In the latter case, the capacitance determines the resonant frequency, e.g., to tune the first and second LC circuits to specific frequency bands. The frequencies can be tuned individually and independently of each other.

The first and second LC circuits resonate as a function of $1/\sqrt{LC}$. In the illustrated example, the leg 608 of the first loop 602 is longer than the common leg 606 and hence the corresponding leg of the second loop 604. As a result, the first LC circuit resonates at a first resonant frequency and provides a first antenna for a first frequency ban, and the second LC circuit resonates at a second resonant frequency and provides a second antenna for a second different frequency ban. The LC circuits are tuned with a high RF current at the resonant frequency. The RF current generates a strong magnetic field, which, at a certain distance the magnetic wave evolves into an electromagnetic wave.

In the illustrated example, the feed line 524 feeds the multi-loop antenna 516 electrically via an electrical coupling. The electrical coupling includes a first electrical conductor 624 electrically connected at the first junction 610. The electric coupling also includes a second electrical conductor 622 electrically connected to the common leg 606 at a junction 626 between the first and second junctions 610 and 612. The impedance is set through the location of junction 626 between the first and second junctions 610 and 612. The impedance can be the same or different for the two loops 602 and 604, tuned to the same or different frequencies.

Figure 7:
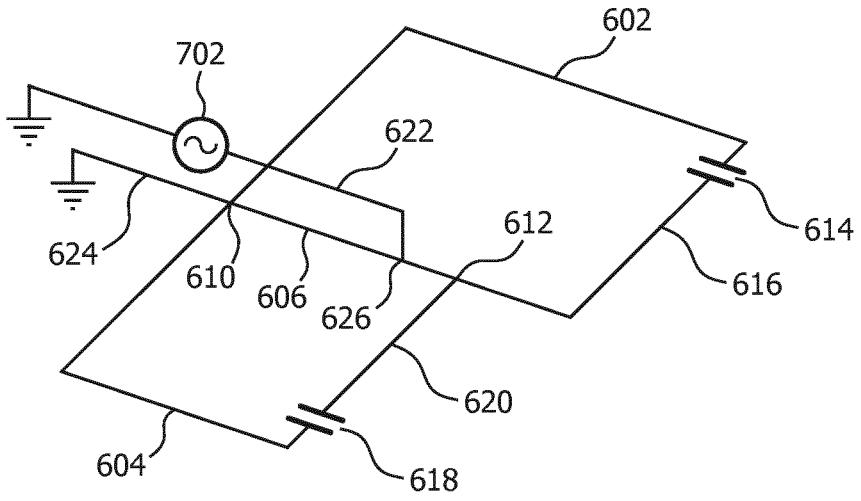

FIG. 7 schematically illustrates a perspective view of the wireless communication component 510, the multi-loop antenna 516, and the feed line 524 described in FIG. 6. In this example, the wireless communication component 510 is represented through an alternating source 702. The first and second loops 602 and 604 are in a single same plane, and the second electrical conductor 622 is elevated in a plane (e.g., perpendicular as shown or oblique) to the common leg 606.

Figure 8:
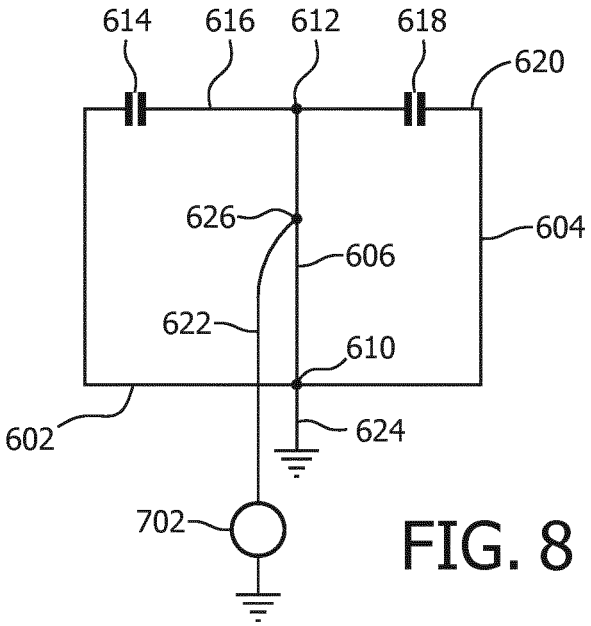
FIGS. 8-14 schematically illustrate other examples of the multi-loop antenna and the single common feed.

FIG. 8 shows a variation of the multi-loop antenna 516 described in FIG. 6. In this variation, a geometry of the second loop 604 is different such that the common leg 606 is a full leg of both the first loop 602 and the second loop 604. This configuration matches impedance at both single frequencies.

Figure 9:
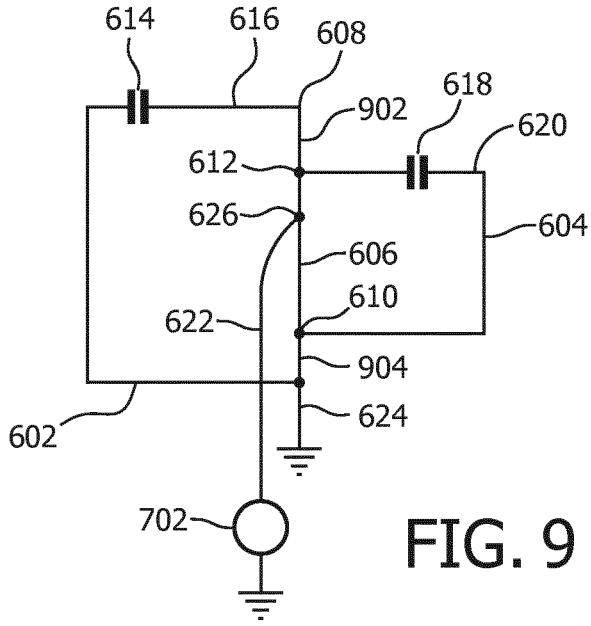

FIG. 9 shows another variation of the multi-loop antenna 516 described in FIG. 6. In this variation, a geometry and a position of the second loop 604 is changed so that the leg 608 of the first loop 602 includes the common leg 606 and first and second sub-portions 902 and 904 extending from opposing ends of the common leg 606.

Figure 10:
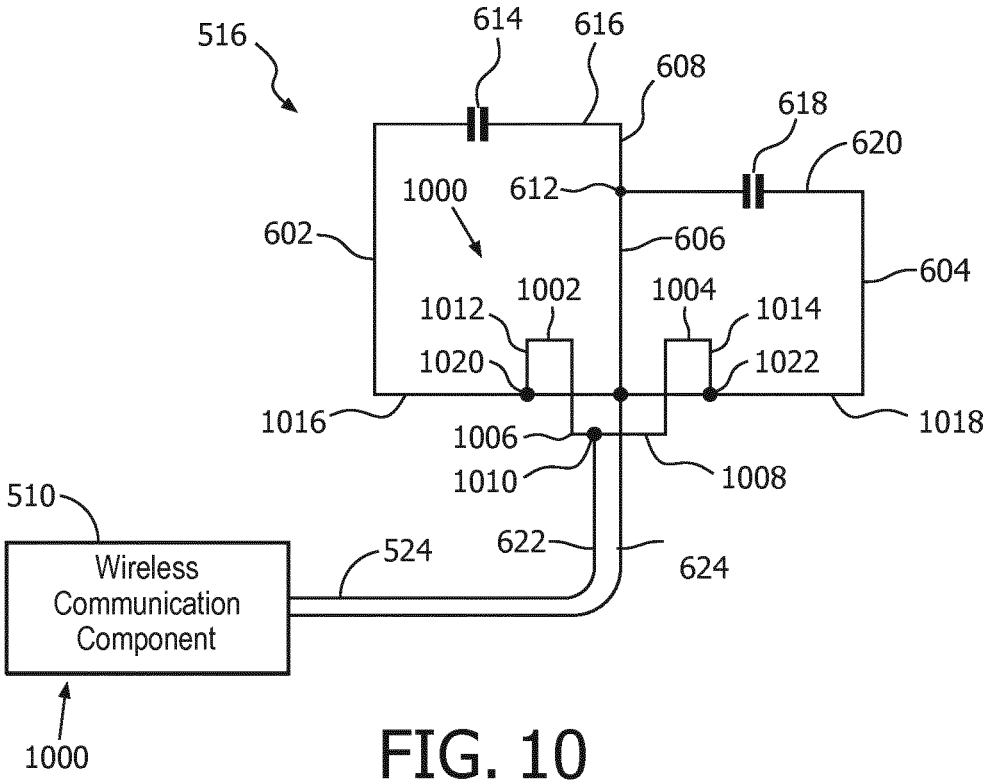
Figure 11:
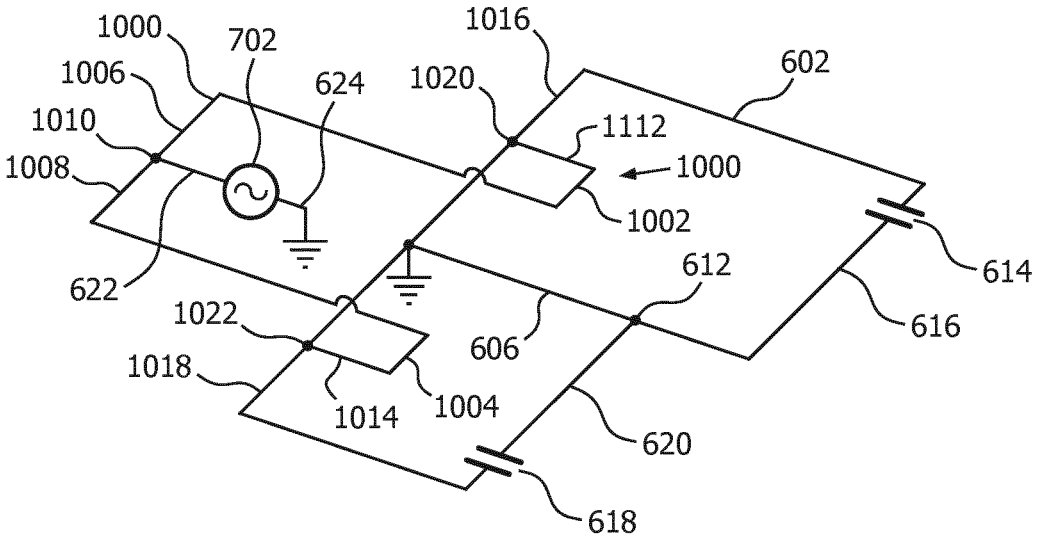

FIG. 10 schematically illustrates an example embodiment of the wireless communication component 510, the multi-loop antenna 516, and the feed line 524 with an inductive coupling 1000 feeding the multi-loop antenna 516. FIG. 11 schematically illustrates a perspective view of the wireless communication component 510, the multi-loop antenna 516, and the feed line 524 described in FIG. 10. As discussed herein, the first and second loops 602 and 604 are electrically in parallel.

The inductive coupling 1000 includes a first inductive coupling 1002 for the first loop 602 and a second inductive coupling 1004 for the second loop 604. Ends 1006 and 1008 of the first and second couplings 1002 and 1004 and the second conductor 622 are electrically connected at a junction 1010. Opposing ends 1012 and 1014 of the first and second couplings 1002 and 1004 respectively are electrically connected to legs 1016 and 1018 at junctions 1020 and 1022. Impedance matching is achieved through a relative size of the first coupling 1002 and the second coupling 1004.

Figure 12:
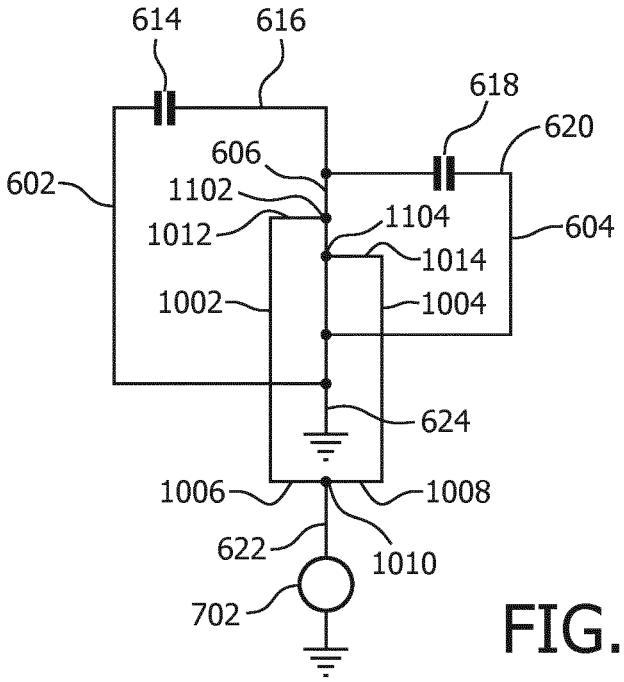

FIG. 12 schematically illustrates a variation of the wireless communication component 510, the multi-loop antenna 516, and the feed line 524 described in FIG. 10. In this example, the opposing ends 1012 and 1014 of the first and second couplings 1002 and 1004 respectively are electrically connected to the common leg 606 at junctions 1102 and 1104.

Figure 13:
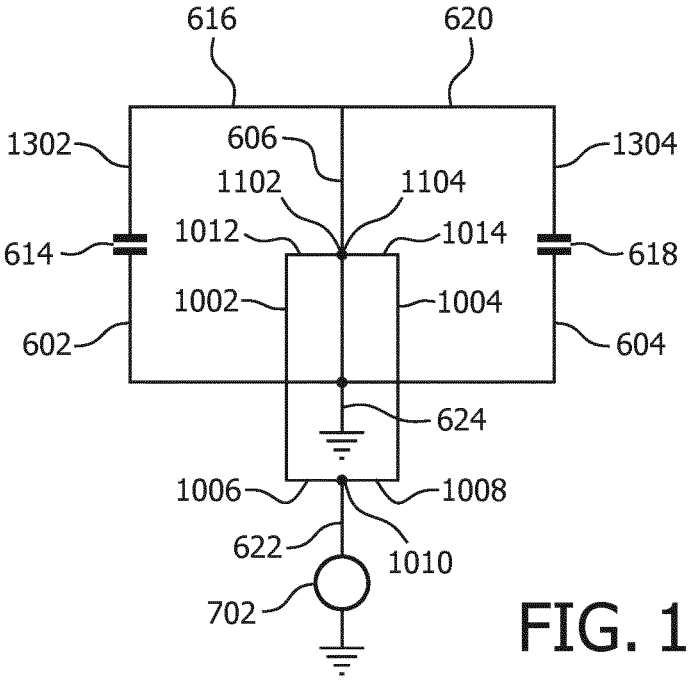

FIG. 13 schematically illustrates a variation of the wireless communication component 510, the multi-loop antenna 516, and the feed line 524 described in FIG. 12. In this example, the junctions 1102 and 1104 are the same junction. Furthermore, the capacitors 614 and 618 are located in legs 1302 and 1304 rather than legs 616 and 620. In general, the capacitors 614 and 618 can located in any of the legs of the first and second loops 602 and 604.

Figure 14:
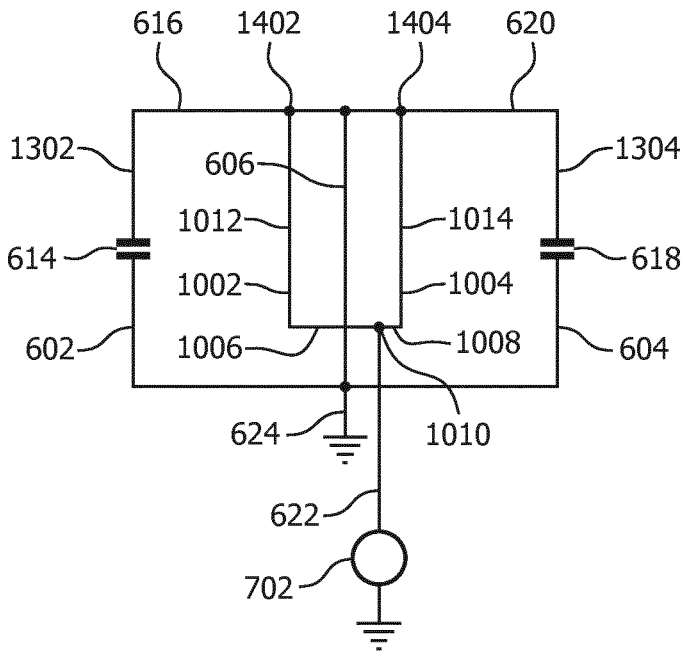

FIG. 14 schematically illustrates a variation of the wireless communication component 510, the multi-loop antenna 516, and the feed line 524 described in FIG. 12. In this example, the opposing ends 1012 and 1014 of the first and second couplings 1002 and 1004 respectively are electrically connected to legs 616 and 620 at junctions 1402 and 1404.

Figure 15:
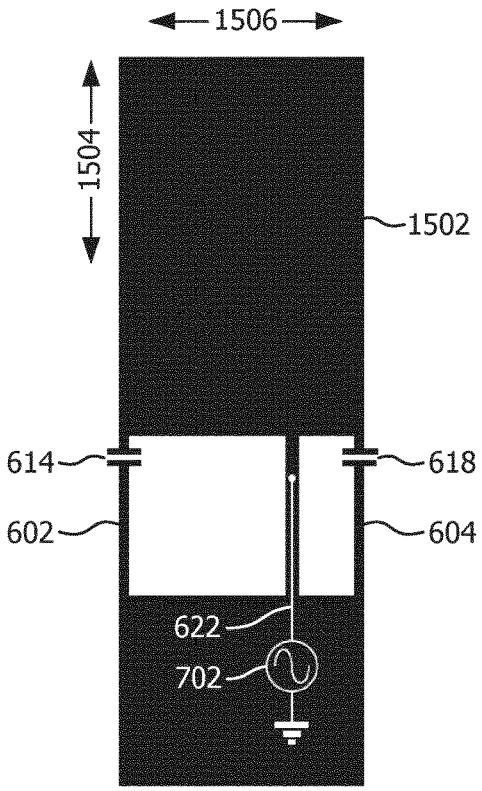
FIGS. 15-18 schematically illustrate examples of the multi-loop antenna and the single common feed implemented in a metal sheet.
Figure 16:
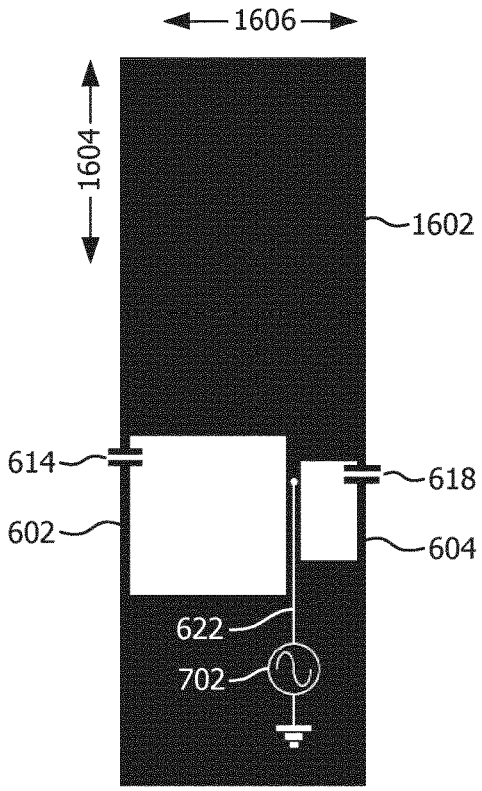
Figure 17:
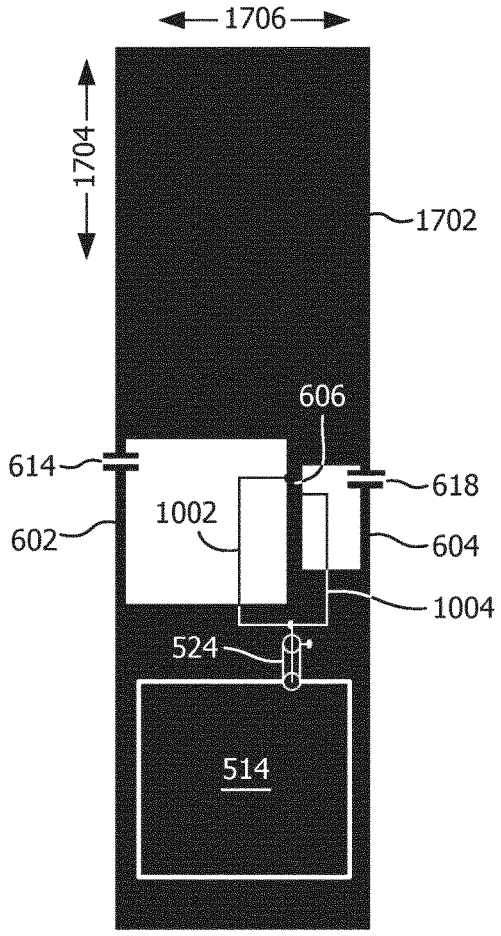

FIGS. 15, 16 and 17 show FIGS. 8, 9 and 12 respectively implemented in metal sheets 1502, 1602 and 1702. In FIGS. 15, 16 and 17, the metal sheets 1502, 1602 and 1702 have long axes 1504, 1604 and 1704 and short axes 1506, 1606 and 1706. The loops 602 and 604 are arranged next to each other along the short axes 1506, 1606 and 1706 with the common leg 606 extending parallel to the long axes 1504, 1604 and 1704. FIGS. 15 and 16 show the alternating source 702, wherein FIG. 17 shows the wireless communication component 514 as a chip mounted to the metal sheet 1702. The metal sheets 1502, 1602 and 1702 can be part of printed circuit boards (PCB'S), a wired board, or the like.

Figure 18:
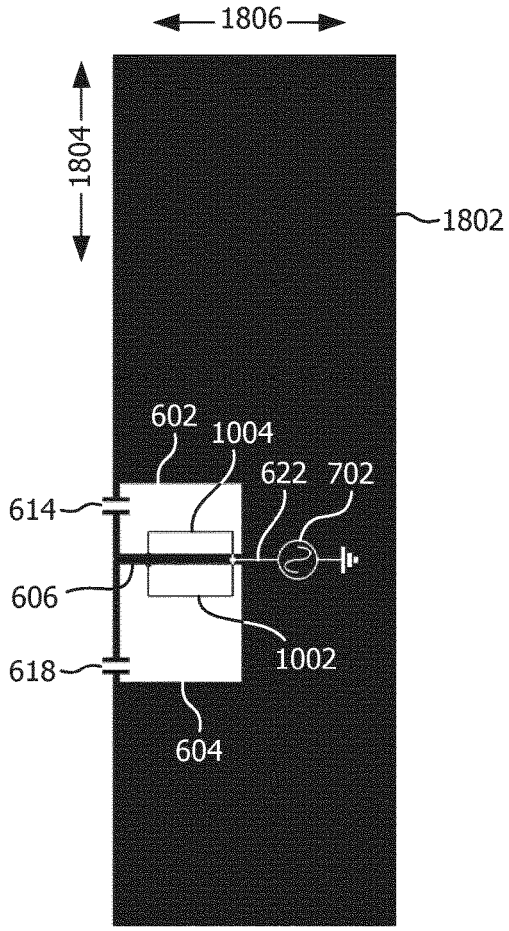

FIG. 18 schematically illustrates another example implemented in a metal sheet 1802. However, in contrast to the embodiment described in connection with FIGS. 15, 16 and 17, in the embodiment of FIG. 18 the loops 602 and 604 are arranged next to each other along a long axis 1804 with the common leg 606 extending parallel to a short axis 1806.

Figure 22:
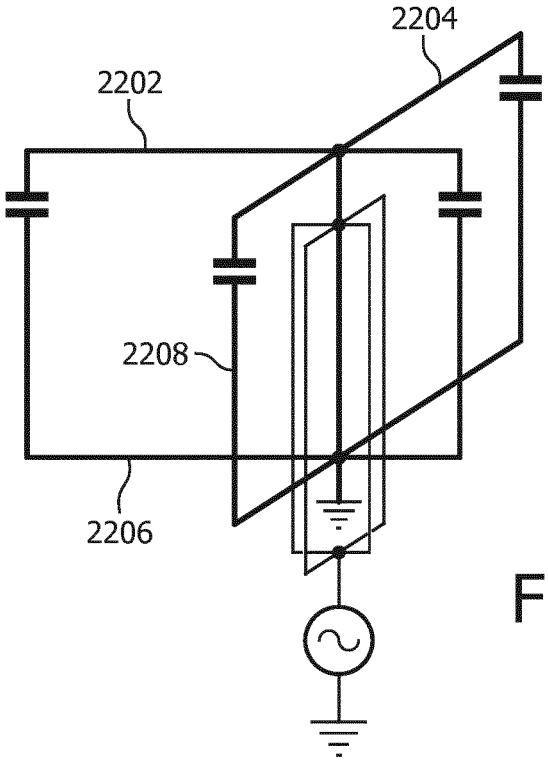
FIGS. 22 and 23 schematically illustrate examples of the multi-loop antenna with more than two loops.
Figure 23:
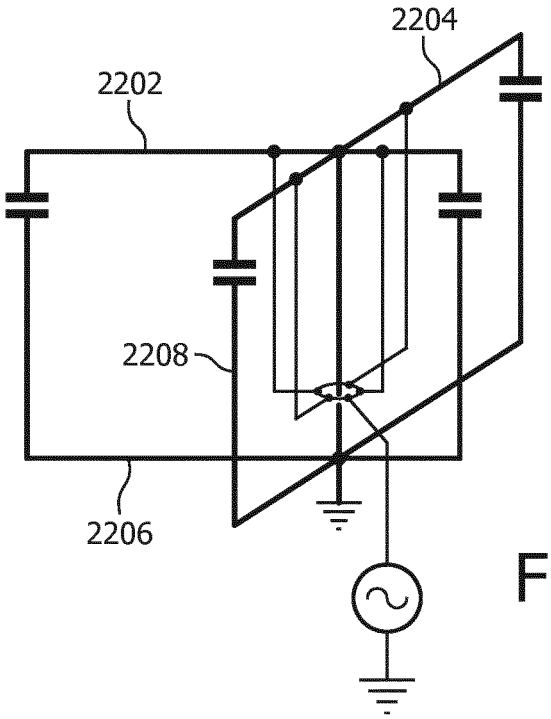

FIGS. 6-18 describe dual antenna configuration. However, it is to be understood that in another variation the multi-loop antenna 516 includes three or more loops (or three or more antennas). In such a configuration, one or more of the loops can be at an angle orthogonal or oblique to another loop. FIGS. 22 and 23 schematically illustrate examples of the multi-loop antenna 516 with loops 2202, 2204, 2206 and 2208.

Figure 19:
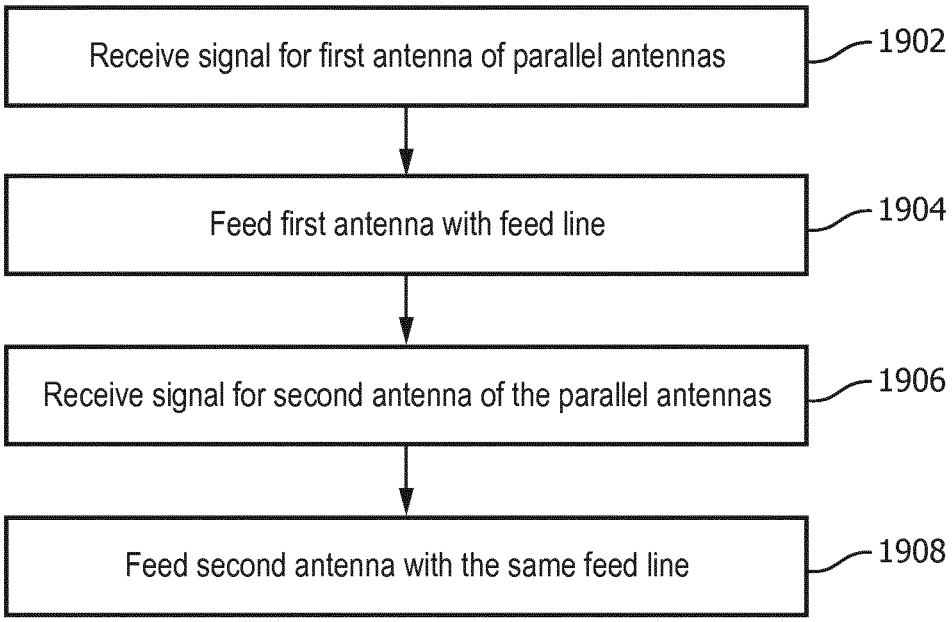
FIG. 19 illustrates an example method in accordance with at least one embodiment discussed herein.

FIG. 19 illustrates an example method in accordance with at least one embodiment described herein.

It is to be appreciated that the ordering of the acts is not limiting. As such, other orderings are contemplated herein. In addition, one or more acts may be omitted and/or one or more additional acts may be included.

At 1902, a first activation signal for a first magnetic loop antenna of at least two magnetic loop antennas electrically connected in parallel is received.

At 1904, the first magnetic loop antenna is driven with a feed line.

At 1906, a second activation signal for a second magnetic loop antenna of the at least two magnetic loop antennas electrically connected in parallel is received.

At 1908, the second magnetic loop antenna is driven with the same feed line.

The invention has been described with reference to the preferred embodiments. Modifications and alterations may occur to others upon reading and understanding the preceding detailed description. It is intended that the invention be constructed as including all such modifications and alterations insofar as they come within the scope of the appended claims or the equivalents thereof.

The invention claimed is:

1. A device, comprising:

a multi-loop antenna, including:

at least two magnetic loop antennas electrically connected in parallel, wherein the at least two magnetic loop antennas each are configured to transmit and receive signals over predetermined frequency bands and wherein the at least two magnetic loop antennas share a common leg;

a single feed line configured to drive both of the at least two magnetic loop antennas; and a wireless communication component configured to drive the single feed line.

2. The device of claim 1, wherein the at least two magnetic loop antennas are disposed in a same plane, and a sub-portion of the single feed line is in a different plane.

3. The device of claim 1 wherein the common leg is a sub-portion of a leg of at least one of the at least two magnetic loop antennas.

4. The device of claim 1 wherein the common leg is an entire leg of both of the at least two magnetic loop antennas.

5. The device of claim 1, further comprising: a metal substrate, wherein the at least two magnetic loop antennas disposed on part of the metal substrate.

6. The device of claim 5, wherein the wireless communication component is disposed on of the metal substrate.

7. An apparatus configured to be carried or worn by a user, comprising:

the wireless mobile device of claim 1.

8. The apparatus of claim 7, wherein the apparatus includes a pendent.

9. The apparatus of claim 7, wherein the multi-loop antenna includes three or more magnetic loop antennas.

10. A method, comprising:

receiving a first activation signal for a first magnetic loop antenna of at least two magnetic loop antennas electrically connected in parallel, wherein the at least two magnetic loop antennas share a common leg;

feeding the first magnetic loop antenna with a feed line and a first coupling loop coupling the feed line to the first magnetic loop antenna;

receiving a second activation signal for a second magnetic loop antenna of the at least two magnetic loop antennas electrically connected in parallel; and feeding the second magnetic loop antenna with the same feed line and a second coupling loop coupling the feed line to the second magnetic loop antenna.

11. The device of claim 1, further including:

a first coupling loop coupling the feed line with a first of the at least two magnetic loop antennas; and a second loop coupling the feed line with a second of the at least two magnetic loop antennas.

12. The device of claim 11, wherein the first and second coupling loops are electrically connected to the common leg.

13. The device of claim 11, wherein each of the at least two magnetic loop antennas includes a second leg, and the first and second coupling loops are electrically connected to corresponding second legs of that at least two magnetic loop antennas.

14. The device of a claim 11, wherein the first coupling loop loops over a leg of a first of the at least two magnetic loop antennas and the second coupling loop loops over a leg of a second of the at least two magnetic loop antenna's.

15. The device of claim 14, wherein the first coupling loop inductively couples with a first of the at least two magnetic loop antennas: and the second coupling loop inductively couples with a second of the at least two magnetic loop antennas.

* * * * *